US008958564B2

(12) United States Patent
Par

(10) Patent No.: US 8,958,564 B2
(45) Date of Patent: Feb. 17, 2015

(54) DEVICE AND METHOD FOR IMPROVING STEREOPHONIC OR PSEUDO-STEREOPHONIC AUDIO SIGNALS

(75) Inventor: Clemens Par, Cinuos-chel (CH)

(73) Assignee: Stormingswiss GmbH, Morges (CH)

( * ) Notice: Subject to any disclaimer, the term of this patent is extended or adjusted under 35 U.S.C. 154(b) by 327 days.

(21) Appl. No.: 13/352,762

(22) Filed: Jan. 18, 2012

(65) Prior Publication Data

US 2012/0128161 A1 May 24, 2012

Related U.S. Application Data

(63) Continuation of application No. PCT/EP2010/055876, filed on Apr. 29, 2010.

(30) Foreign Application Priority Data

Jul. 22, 2009 (CH) ..... 2009-1159
Nov. 18, 2009 (CH) ..... 2009-1776

(51) Int. Cl.
*H04R 5/00* (2006.01)
*H04S 5/00* (2006.01)

(52) U.S. Cl.
CPC ..... *H04S 5/00* (2013.01)
USPC ..... 381/17

(58) Field of Classification Search
CPC ..... H04S 5/00
USPC ..... 381/2, 17
See application file for complete search history.

(56) References Cited

U.S. PATENT DOCUMENTS 4,524,451 A * 6/1985 Watanabe ..... 381/1
5,173,944 A 12/1992 Begault
5,555,306 A 9/1996 Gerzon
5,671,287 A 9/1997 Gerzon

FOREIGN PATENT DOCUMENTS

DE 4440451 A1 5/1996
EP 0825800 A2 2/1998
EP 1850639 A1 10/2007
EP 2124486 A1 11/2009

OTHER PUBLICATIONS

International Search Report for PCT/EP2010/055876 dated Sep. 6, 2010.

* cited by examiner

*Primary Examiner* — Alexander Jamal
(74) *Attorney, Agent, or Firm* — Pearne & Gordon LLP

(57) ABSTRACT

The proposed apparatus or the proposed method permits the linear variation of the degree of correlation particularly of pseudo-stereophonic audio signals, and overall provides a comprehensive, albeit extremely simple, postprocessing option. This is desirable in telephony, for example, which, even today, is still almost fundamentally based on a mono signal, in the area of professional postprocessing of audio signals, particularly for narrowing or expanding the mapping width thereof, for obtaining stable FM stereo signals, or else in the area of high quality electronic consumer goods, the aim of which is extremely simple but efficient handling.

28 Claims, 12 Drawing Sheets

Prior Art

DEVICE AND METHOD FOR IMPROVING STEREOPHONIC OR PSEUDO-STEREOPHONIC AUDIO SIGNALS

The present application is a continuation of international application PCT/EP2010/055876, the contents of which is hereby incorporated by reference. It claims priority from Swiss patent application CH2009/1159 filed on Jul. 22, 2009, the contents of which is hereby incorporated by reference, and of Swiss patent application CH2009/1776 filed on Nov. 18, 2009, the contents of which is hereby incorporated by reference.

The invention relates to audio signals and apparatuses or methods for the generation, transmission, conversion and reproduction thereof.

It is general knowledge that audio signals which are emitted via two or more loudspeakers provide the listener with a spatial impression, provided that they show different amplitudes, frequencies, time or phase differences or are reverberated appropriately.

Methods are also known for converting a mono signal into two different audio signals which give the impression of a stereo signal. These solutions to this problem are used particularly in order to convert monophonic audio signals into audio signals which are suggestive of a real or fictitious spatiality to the ear. When a pair of different, partially correlated audio signals is generated from a mono signal, this is referred to as "pseudo-stereophony".

EP0825800 (Thomson Brandt GmbH) proposes the formation of different kinds of signals from a mono input signal by means of filtering, which signals are used—for example by using a method proposed by Lauridsen based on amplitude and time difference corrections, depending on the recording situation—to generate virtual single-band stereo signals separately, these subsequently being combined to form two output signals.

EP2124486 and EP1850639 describe, by way of example, a method for methodically evaluating the angle of incidence for the sound event that is to be mapped, said angle of incidence being enclosed by the main axis of the microphone and the directional axis for the sound source, this being achieved by applying time differences and amplitude corrections which are functionally dependent on the original recording situation (which may be interpolated by using the system). The content of EP2124486 and of EP1850639 is hereby introduced as a reference.

U.S. Pat. No. 5,173,944 (Begault Durand) applies HRTFs (Head Related Transfer Functions) which correlate with 90, 120, 240 and 270 degrees azimuth, respectively, to the varyingly delayed but uniformly amplified monophonic input signal, the signals formed in turn being finally superimposed on the original mono signal. In this case, the amplitude correction and the time difference corrections are chosen independently of the recording situation.

Some pseudo-stereophonic signals show increased "phasiness", that is to say distinctly perceptible time differences between both channels. Frequently, the degree of correlation between both channels also is too low (lack of compatibility) or too high (undesirable convergence towards a mono sound). Pseudo-stereophonic, but also stereophonic, signals may therefore show deficiencies due to lacking or excessive decorrelations between the emitted signals.

It is therefore an aim of the invention to solve this problem and to align stereophonic (including pseudo-stereophonic) signals or, conversely, to differentiate them to a greater extent.

It is another aim to improve, to generate, to transmit, to convert or to reproduce stereophonic and pseudo-stereophonic audio signals.

DISCLOSURE OF THE INVENTION

The invention is used to solve these problems inter alia by means of the ostensibly not purposeful downstream connection of a panoramic potentiometer in an apparatus for pseudo-stereo conversion.

Panoramic potentiometers (also called pan pots or panoramic controllers) are known per se and are used for intensity stereophonic signals, that is to say for stereo signals which differ exclusively in terms of their levels but not in terms of time or phase differences or different frequency spectra. The circuit principle of a known panoramic potentiometer is shown in FIG. 1. The device has an input 101 and two outputs 202, 203 which are connected to the buses 204, 205 for the group channels L (left audio channel) and R (right audio channel). In the center position (M), both buses receive the same level; in the side positions to the left (L) and to the right (R), the signal is routed only to the left bus or to the right bus, respectively. In the intermediate positions, a panoramic potentiometer produces level differences which correspond to the different positions of the phantom source on the sound stage.

FIG. 2 shows the attenuation curve for the left channel and the right channel of a panoramic potentiometer without an extended stereo width range, and corresponding mapping angles. In the center position, the attenuation in each channel is 3 dB, the acoustic convolution thereby producing the same perception of level as would be with only one channel in the L or R position.

Panoramic potentiometers, as they represent voltage dividers, are able, for instance, to distribute the left channel in a different, selectable ratio to the resulting left output and to the resulting right output (these outputs are also called buses) or in the same way to distribute the right channel in a different, selectable ratio to the same left output and to the same right output (the same buses). Therefore, in the case of intensity stereophonic signals, the mapping width can be narrowed and the direction of such signals can be shifted.

In the case of pseudo-stereophonic signals, which make use of time or phase differences, different frequency spectra or reverberation (and also in the case of stereo signals of such kind in general), such narrowing of the mapping width or shifting of the mapping direction are not possible by using a panoramic potentiometer. Application of panoramic potentiometers to such signals is therefore fundamentally disregarded intendedly.

In line with the invention, however, it has been unexpectedly—and contrary to experience to date—found that the previously unknown downstream connection of a panoramic potentiometer downstream to a circuit for pseudo-stereo conversion affords unexpected advantages. Although such downstream connection cannot result in the aforementioned narrowing of the mapping width or in the shifting of the mapping direction of the stereo signals obtained, the degree of correlation between the left signal and the right signal can be increased or else lowered in this way by using such a panoramic potentiometer.

In one preferred embodiment, a respective panoramic potentiometer is connected downstream to the left output and to the right output of the circuit for obtaining a pseudo-stereophonic signal. In this case, the buses of both panoramic potentiometers are preferably used collectively and preferably identically.

In this arrangement, each panoramic potentiometer has an input and two outputs. The input of a first panoramic potentiometer is connected to a first output of the circuit, and the input of a second panoramic potentiometer is connected to a second output of this circuit. The first output of the first panoramic potentiometer is connected to the first output of the second panoramic potentiometer. The second output of the first panoramic potentiometer is connected to the second output of the second panoramic potentiometer.

Alternatively and equivalently, rather than using panoramic potentiometers, the degree of correlation can also be adjusted by using a first circuit for pseudo-stereo conversion having an MS matrix and an amplifier, connected upstream to the MS matrix, for amplifying an input signal for the MS matrix, this being achieved without a panoramic potentiometer. Equivalent adjustment of the degree of correlation can therefore be implemented with fewer components.

Alternatively and equivalently, rather than using a panoramic potentiometer, the degree of correlation can also be varied by using a second circuit, this being achieved with a modified MS matrix which contains an adder and a subtractor in order to add or subtract, respectively, input signals (M, S), which are respectively amplified by predetermined factors, in order to generate signals which are identical to the bus signals from the panoramic potentiometers. Equivalent adjustment of the degree of correlation can therefore be implemented with even fewer components.

The invention can also be applied to apparatuses or methods which generate signals which are reproduced by more than two loudspeakers (for example surround sound systems belonging to the prior art).

BRIEF DESCRIPTION OF THE FIGURES

Various embodiments of the present invention are described by way of example below, with reference being made to the following drawings.

DETAILED DESCRIPTION OF VARIOUS EMBODIMENTS OF THE SUBJECT MATTER OF THE INVENTION

Figure 1:
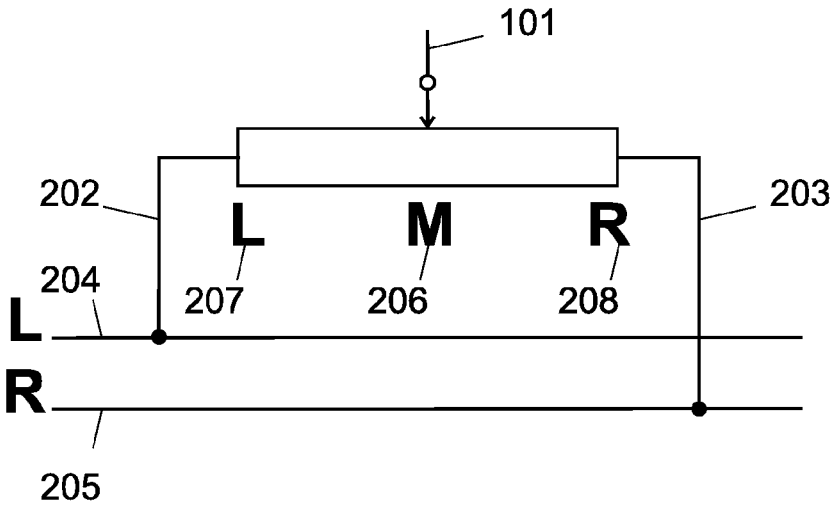
FIG. 1 shows the circuit principle of a known panoramic potentiometer.
Figure 2:
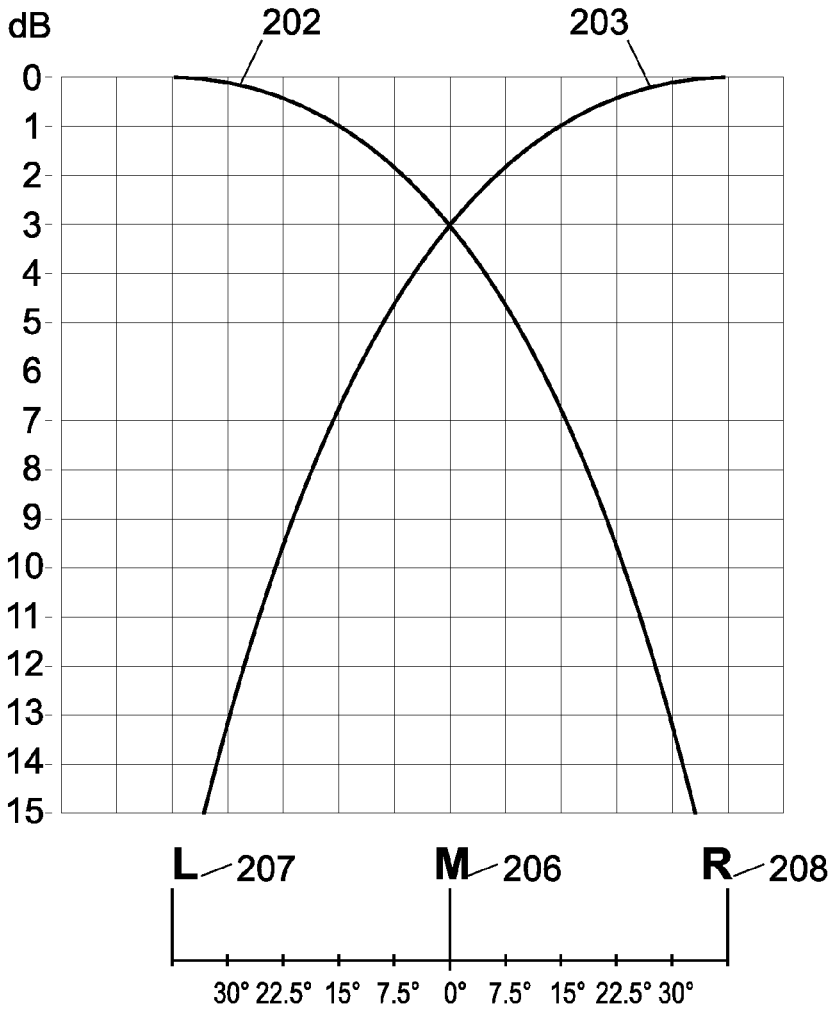
Prior Art Fig. 2
FIG. 2 shows the attenuation curve of the left channel and of the right channel of a panoramic potentiometer without an extended stereo width range, and corresponding mapping angles.
Figure 3:
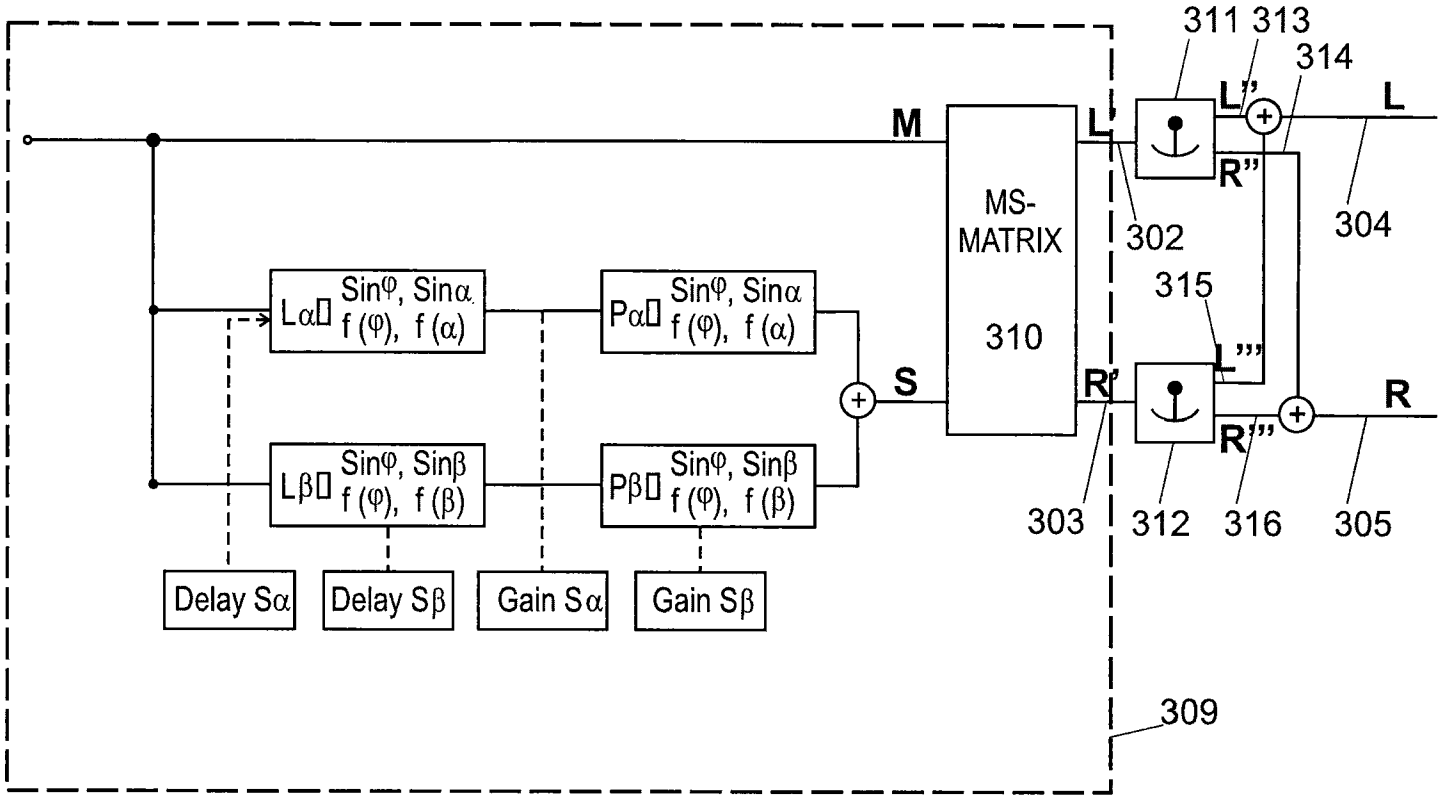
FIG. 3 shows a first embodiment of the invention, in which, respectively, the left channel L' and the right channel R' resulting from the MS matrixing are each fed to a panoramic potentiometer for collective buses L and R.
Figure 4:
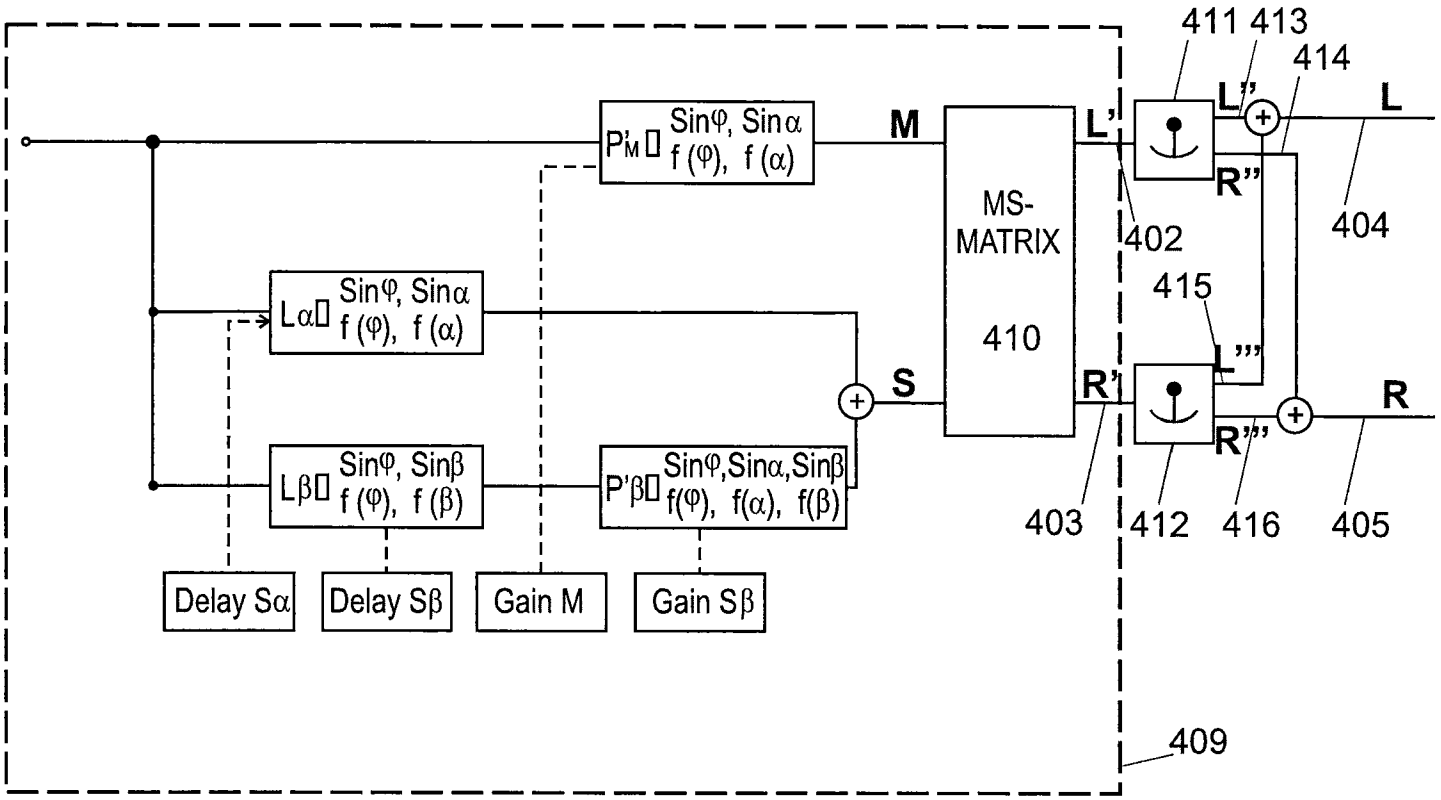
FIG. 4 shows a second embodiment of the invention.
Figure 5:
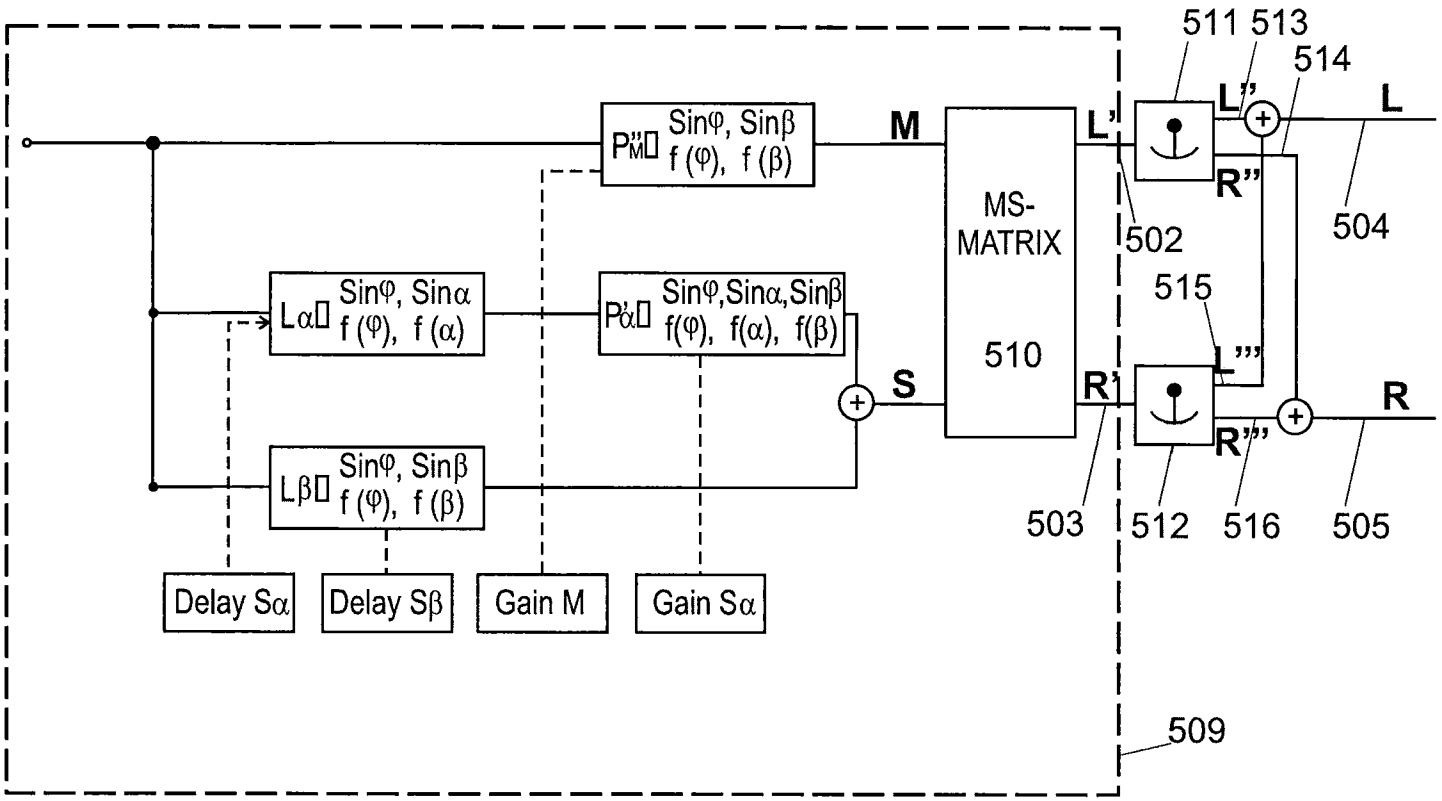
FIG. 5 shows a third embodiment of the invention.

FIGS. 3 to 5 show various embodiments of a circuit according to the invention in which a respective panoramic potentiometer 311 and 312, 411 and 412, 511 and 512 is connected directly downstream to a pseudo-conversion circuit 309, 409 and 509, respectively. In each example shown here, the pseudo-conversion circuit 309, 409 or 509 comprises a circuit having an MS matrix 310, 410 or 510, as described in EP2124486 and likewise in EP1850639.

This panoramic potentiometer 311 and 312, 411 and 412, 511 and 512 can be used to increase or lower the degree of correlation of the resulting buses L 304, 404, 504 and R 305, 405, 505. Accordingly, the left channel L' 302, 402, 502 and the right channel R' 303, 403, 503 resulting from the MS matrixing are fed to a respective panoramic potentiometer for collectively used buses L and R.

If the attenuation $\lambda$ for the left input signal L' for the panoramic potentiometer 311, 411 or 511 and the attenuation $\rho$ for the right input signal R' for the panoramic potentiometer 312, 412, 512 with a stereo signal 302 and 303, 402 and 403, 502 and 503 resulting from an apparatus 309, 409 or 509 is limited to the range between 0 and 3 dB, the inversely proportional relations $$1\geq\lambda\geq0$$

and $$1\geq\rho\geq0$$

may be introduced (where 1 corresponds to the value 0 dB and 0 corresponds to the value 3 dB).

$\lambda$ and $\rho$ therefore correspond to the inversely proportional attenuations of the panoramic potentiometers shown in FIG. 3 to FIG. 5, limited to the range between 0 and 3 dB.

Therefore, the following relations are obtained for the resulting stereo signals (buses) L and R (304 and 305, 404 and 405, 504 and 505) and, respectively, the output signals L" 313, 413, 513 and R" 314, 414, 514 from the panoramic potentiometer 311, 411, 511 and the output signals L'" 315, 415, 515 and R'" 316, 416, 516 from the panoramic potentiometer 312, 412, 512:

$$L=L''+L'''=\tfrac{1}{2}*L'(1+\lambda)+\tfrac{1}{2}*R'(1-\rho) \quad (1)$$

and $$R=R''+R'''=\tfrac{1}{2}*L'(1-\lambda)+\tfrac{1}{2}R'(1+\rho) \quad (2)$$

Figure 6:
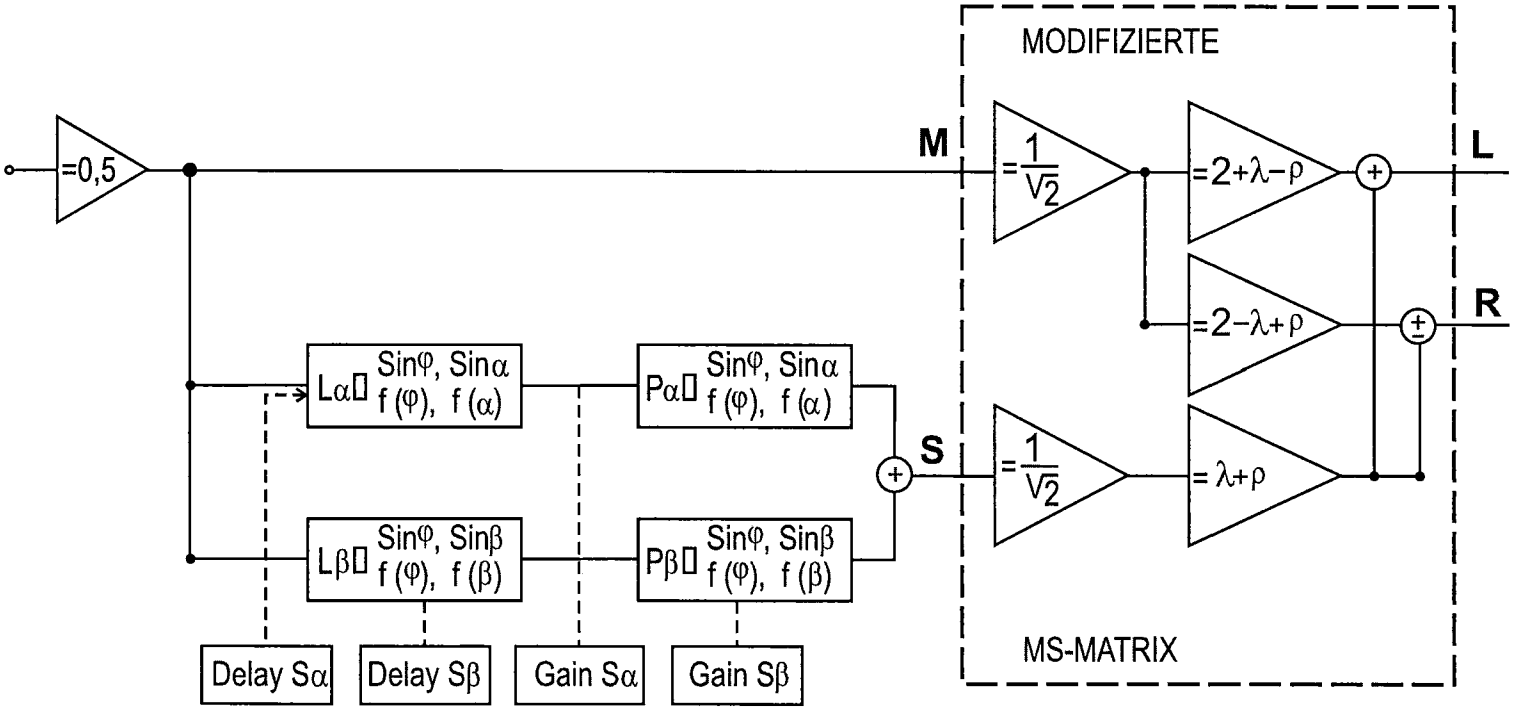
FIG. 6 shows a fourth embodiment of the invention with a circuit which is equivalent to FIG. 3 having a slightly modified MS matrix, which renders direct downstream connection of panoramic potentiometers superfluous.

FIG. 6 shows a further embodiment with a circuit equivalent to FIG. 3 having a slightly modified MS matrix, which renders direct downstream connection of panoramic potentiometers superfluous. Taking account of the equivalences of the MS matrixing $$L'=(M+S)*1/\sqrt{2}$$

and $$R'=(M-S)*1/\sqrt{2},$$

the following relations are obtained:

$$L=[M(2+\lambda-\rho)+S(\lambda+\rho)]*\tfrac{1}{2}\sqrt{2} \quad (1)$$

$$R=[M(2-\lambda+\rho)-S(\lambda+\rho)]*\tfrac{1}{2}\sqrt{2} \quad (2)$$

This allows the signals on the buses L and R to be also derived directly from the input signals M and S for the MS matrixing circuit.

If $\lambda=\rho$ (the same attenuation in the left channel and in the right channel), the following relations are true:

$$L=(M+\lambda*S)*1/\sqrt{2} \quad (3)$$

$$R=(M-\lambda*S)*1/\sqrt{2}$$

i.e. the variation in the amplitude of the signal S is equivalent to the downstream connection of a respective panoramic potentiometer for identical attenuation in the left channel and in the right channel. Under these assumptions, the output signals L and R correspond to the bus signals L and R in FIG. 3.

Therefore, a circuit or a method is obtained showing the form in FIG. 6, for example (trivial modifications being possible), which forms a composite signal from the M signal, amplified by the factor $(2+\lambda-\rho)$, and the S signal, amplified by the factor $(\lambda+\rho)$, and also a difference signal which is compiled from the M signal, amplified by the factor $(2-\lambda+\rho)$, minus the S signal, amplified by the factor $(\lambda+\rho)$, with correction by the factor $\tfrac{1}{2}\sqrt{2}$ needing to be performed overall in order to obtain signals L and R equivalent to formulae (1) and (2).

Figure 7:
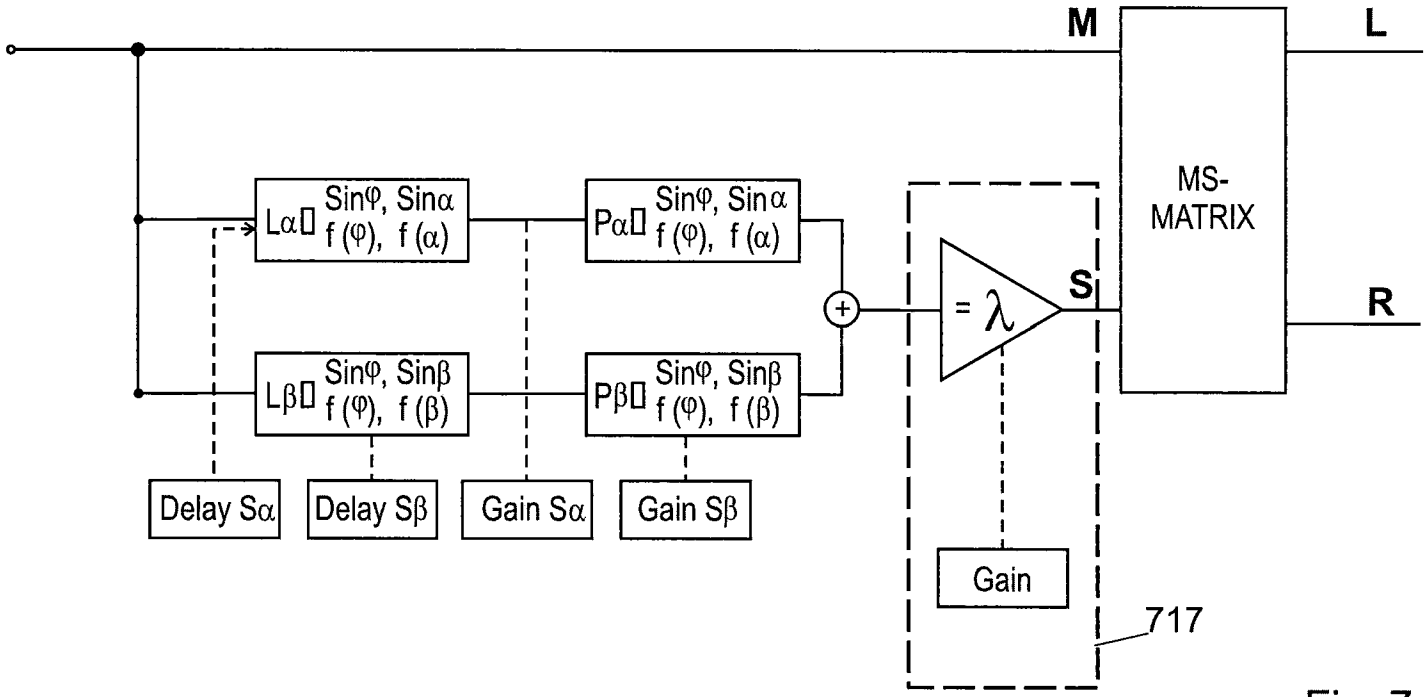
FIG. 7 shows a circuit which is equivalent to FIG. 3 or FIG. 6, provided that the relation $\lambda=\rho$ is true for the inversely proportional attenuations $\lambda$ and $\rho$ of the panoramic potentiometers shown in FIG. 3.

FIG. 7 shows a circuit equivalent to FIG. 3 and FIG. 6, provided that the relationship $\lambda=\rho$ is true for the inversely proportional attenuations $\lambda$ and $p\rho$ of the panoramic potentiometers shown in FIG. 3. This circuit should not be confused with the arrangement known from intensity stereophony (MS microphone technique) for altering the recording or opening angle (which does not take place here!).

In this case, it is assumed that uniform attenuation for proposed panoramic potentiometers or modified MS matrix, as just illustrated, is frequently sufficient for aligning or differentiating stereo signals. When $\lambda=\rho$, the apparatus just illustrated is then simplified on the basis of the above formulae (3) and (4) according to:

$$L=(M+\lambda*S)*1/\sqrt{2} \quad (3)$$

$$R=(M-\lambda*S)*1/\sqrt{2} \quad (4)$$

which is equivalent to simple amplitude correction of the S signal (717).

Such amplitude correction for the S signal has been known to date only for the classical MS microphone technique and in the ideal range results in the alteration of the recording or opening angle in that case, which does not take place here. A transfer of the same action principle is not possible (and an application of the MS microphone technique to the present circuit is accordingly not obvious).

In FIG. 7, the S signal is therefore additionally amplified by the factor $\lambda$ $(1\geq\lambda\geq0)$ prior to finally passing through the MS matrix. The resulting stereo signal is equivalent to the bus signals 304 and 305 in FIGS. 3, 404 and 405 in FIGS. 4 and 504 and 505 in FIG. 5 for uniform attenuation and to the output signal L and R in FIG. 6, provided that $\lambda=\rho$ is true in that case.

In practice, this circuit or method can be used to exactly stipulate the degree of correlation, i.e. there is a direct functional relationship between the attenuation $\lambda$ and the degree of correlation r, for which ideally $$0.2\leq r\leq0.7$$

is true. For $\lambda$, a series of experiments has found $$0.07\leq\lambda\leq0.46$$

to be favorable for most applications.

In particular, artifacts (such as disturbing time differences, phase shifts, or the like) can be eliminated without difficulty by using this apparatus or method, whether manually or automatically (algorithmically).

On the basis of the equivalence of downstream panoramic potentiometers with uniform attenuation and amplitude correction of the S signal by the factor $\lambda$ $(1\geq\lambda\geq0)$ prior to final MS matrixing, it is therefore possible to achieve convincing pseudo-stereophony which, on the basis of the original mono signal, grants the listener a comprehensive, albeit extremely simple, post processing option, while fundamentally maintaining the compatibility and avoiding disturbing artifacts.

This apparatus can be used in telephony, for example, in the area of professional post processing of audio signals or else in the area of high quality electronic consumer goods, the aim of which is extremely simple but efficient handling.

Narrowing or Expanding of the Mapping Width

For this application, the additional use of compression algorithms or data reduction methods which are part of the prior art or the consideration of characteristic features, such as the minima or maxima for the pseudo-stereophonic signals obtained, is recommended in order to speed up evaluation thereof in accordance with the invention.

Figure 8:
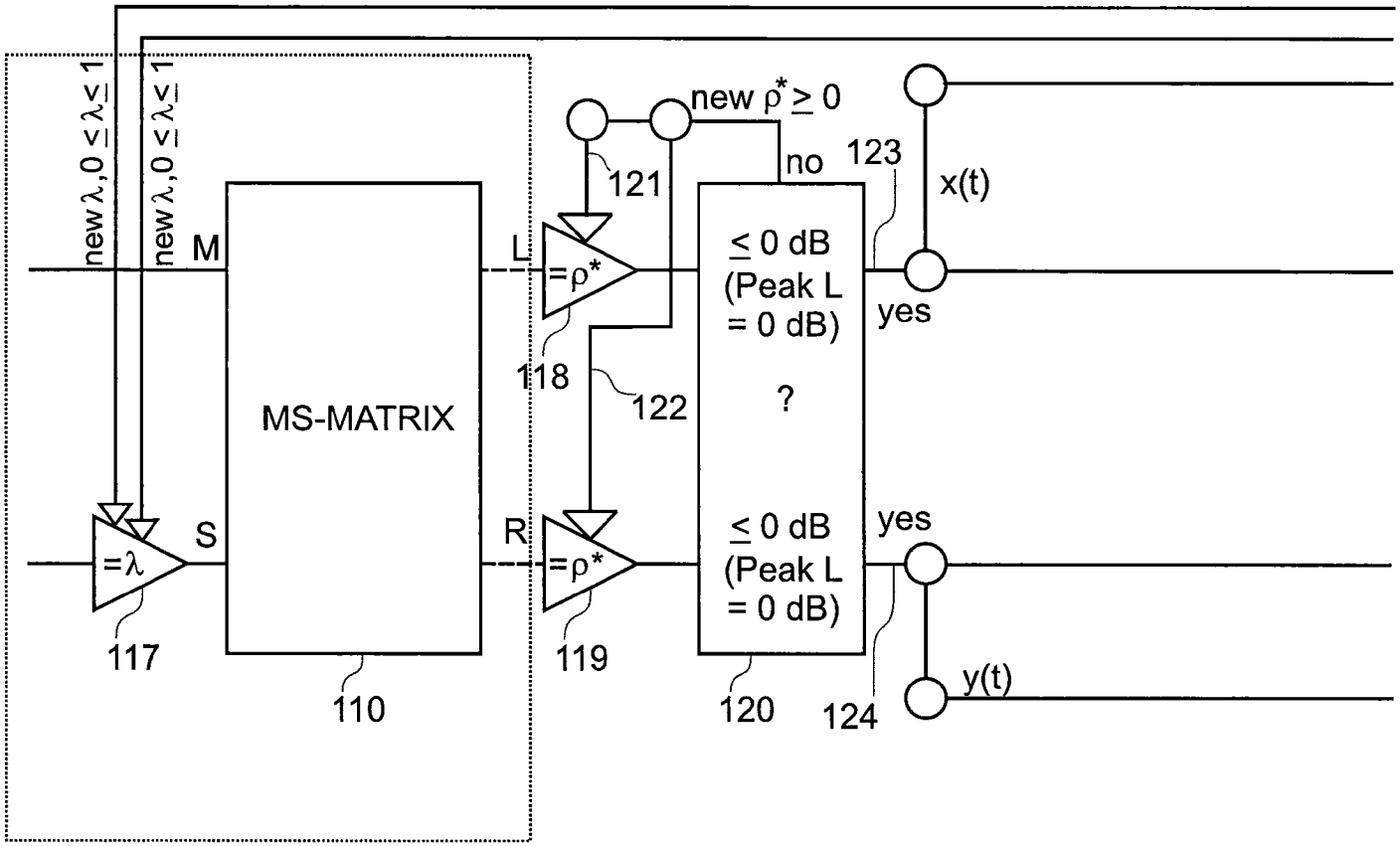
FIG. 8 shows an enhanced circuit based on FIG. 7 for normalizing the level of the output signals from the MS matrix.

Of particular interest (for example for reproducing stereophonic signals in automobiles) is the subsequent narrowing or expanding of the mapping width of the stereo signal obtained by using the specific variation of the degree of correlation r of the resulting stereo signal or, respectively, the attenuations $\lambda$ or else $\rho$ (for forming the resulting stereo signal). The previously determined parameters f (or, respectively, n) which describe the directional pattern of the signal that is to be rendered stereophonic, the angle $\phi$—to be ascertained manually or by metrology—enclosed by the main axis and the sound source, the fictitious left opening angle $\alpha$ and the fictitious right opening angle $\beta$ can be retained in this case, and it makes sense that now only final amplitude correction is necessary, for example as per the logic element 120 in FIG. 8, provided that this narrowing or expanding of the mapping width is performed manually.

If this is intended to be automated, series of psychoacoustic experiments show that a constant mapping width for stereophonic output signals x(t), y(t) or complex transfer functions thereof $$f^*[x(t)]=[x(t)/\sqrt{2}]*(-1+i) \quad (5)$$

$$g^*[y(t)]=[y(t)/\sqrt{2}]*(1+i) \quad (6)$$

is essentially dependent on the criterion $$0\leq S^*-\epsilon\leq\max|Re\{f^*[x(t)]+g^*[y(t)]\}|\leq S^*+\epsilon\leq1 \quad (7)$$

and also on the criterion $$0\leq U^*-\kappa\leq\int_{-T}^{T}|\{f^*[x(t)]+g^*[y(t)]\}|dt\leq U^*+\kappa \quad (8)$$

(where S* and $\epsilon$ or, respectively, U* and $\kappa$ need to be stipulated differently for telephone signals, for example, than for music recordings). Accordingly, it is now necessary to determine only suitable function values x(t), y(t) which are dependent on the degree of correlation r of the resulting stereo signal or, respectively, on the attenuations λ or else ρ (for the formation of the resulting stereo signal) or on a logic element 120 in FIG. 8, in accordance with an iterative operating principle which is based on feedback.

The arrangement according to the invention can accordingly be enhanced as follows within the context of an arrangement, for instance, of the form shown in FIGS. 8 to 10:

An output signal resulting from an arrangement as shown in FIGS. 1 to 7 is in this case amplified uniformly by a factor ρ* (amplifiers 118, 119 in FIG. 8) such that the maximum of both signals has a level of exactly 0 dB (normalization on the unit circle of the complex number plane). By way of example, this is achieved by the downstream connection of a logic element 120 which varies or corrects the gain factor ρ* of the amplifiers 118 and 119 via the feedback loops 121 and 122 until the maximum level for the left channel and for the right channel is 0 dB.

In a further step, the resulting signals x(t) (123) and y(t) (124) are now fed to a matrix in which, following respective amplification by the factor 1/√2 (amplifiers 229, 230 in FIG. 9), they are split into a respective identical real and imaginary part, with the real part formed from the signal x(t), amplified by means of 229, additionally passing through the amplifier 231 with the gain factor −1. Therefore, the transfer functions $$f^*[x(t)]=[x(t)/\sqrt{2}]^*(-1+i) \tag{5}$$

and $$g^*[y(t)]=[y(t)/\sqrt{2}]^*(1+i) \tag{6}$$

are obtained.

The respective real and imaginary parts are now summed and therefore produce the real part and the imaginary part of the sum of the transfer functions f*[x(t)]+g*[y(t)].

Figure 10:
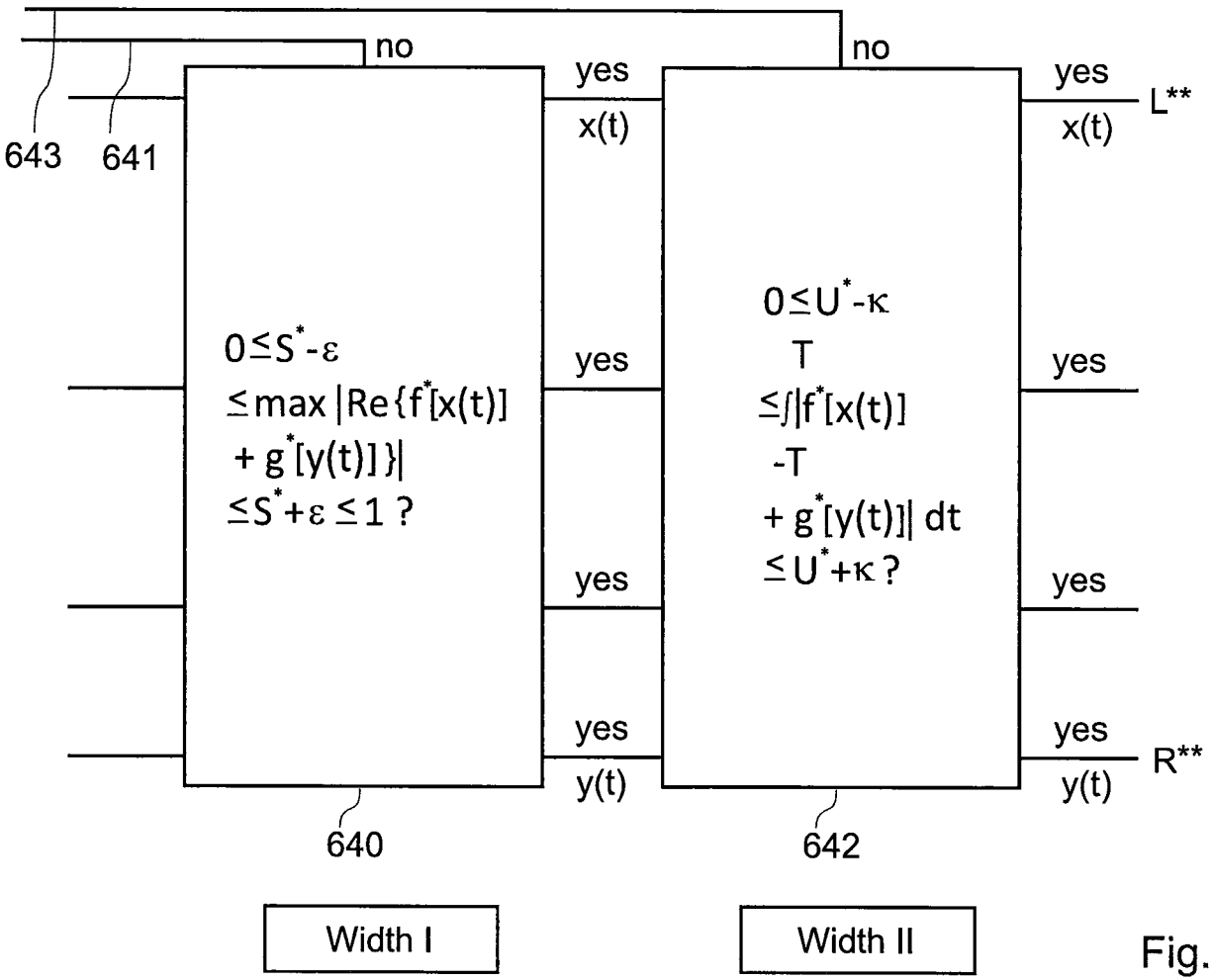
FIG. 10 shows the example of a circuit which, as an enhancement to FIG. 9, stipulates the mapping width of a stereo signal.

An arrangement, for example based on the logic element 640 in FIG. 10, now needs to be connected downstream, which arrangement checks, for a limit value S*—suitably selected by the user with respect to the mapping width of the stereo signal that is to be achieved—or a suitably selected deviation ϵ—both defined by the inequality (7)—whether the condition $$0\le S^*-\epsilon\le\max|Re\{f^*[x(t)]+g^*[y(t)]\}|S^*+\epsilon\le 1 \tag{7}$$

is met. If this is not the case, a feedback loop 641 is used to determine a new optimized value for the degree of correlation r or, respectively, the attenuations λ or else ρ (for the formation of the resulting stereo signal), and the previous steps just described, as illustrated in FIGS. 8 to 10, are performed until the above condition (7) is met.

The input signals for the logic element 640 are now transferred to an arrangement, for example based on the logic element 642 in FIG. 10. Such arrangement finally analyzes the relief of the function f*[x(t)]+g*[y(t)] for the purpose of optimizing the function values in terms of the mapping width of the stereo signal that is to be achieved, the user being able to suitably select the limit value U*and the deviation κ, both defined by the inequality (8), with respect to the mapping width of the stereo signal that is to be achieved. Overall, the condition $$0\le U^*-\kappa\le\int|f^*[x(t)]+g^*[y(t)]|dt\le U^*+\kappa \tag{8}$$

must be met. If this is not the case, a feedback loop 643 is used to determine a new optimized value for the degree of correlation r or, respectively, for the attenuations λ or else ρ (for the formation of the resulting stereo signal), and the previous steps just described, as illustrated in FIGS. 8 to 10, are performed until the relief of the function f*[x(t)]+g*[y(t)] satisfies the desired optimization of the function values with respect to the mapping width taking account of the limit value U*and the deviation κ, both suitably chosen by the user.

In terms of the mapping width—determined by the degree of correlation r or, respectively, the attenuations or else ρ (for the formation of the resulting stereo signal)—the signals x(t) (123) and y(t) (124) therefore correspond to the specifications by the user and represent the output signals L and R from the arrangement which has just been described.

The present considerations remain valid as an entity even if a different reference system than the unit circle of the imaginary plane is chosen. By way of example, instead of normalizing function values, it is also possible to normalize the axis length in order to reduce the computing time accordingly.

Stipulation of the Mapping Direction

Occasionally, it is also important to mirror the stereophonic mapping obtained about the main axis of the directional pattern on which the stereophonic processing is based, since, for instance, mirror-inverted mapping in relation to the main axis occurs. This can be achieved manually by swapping the left channel and the right channel.

Figure 9:
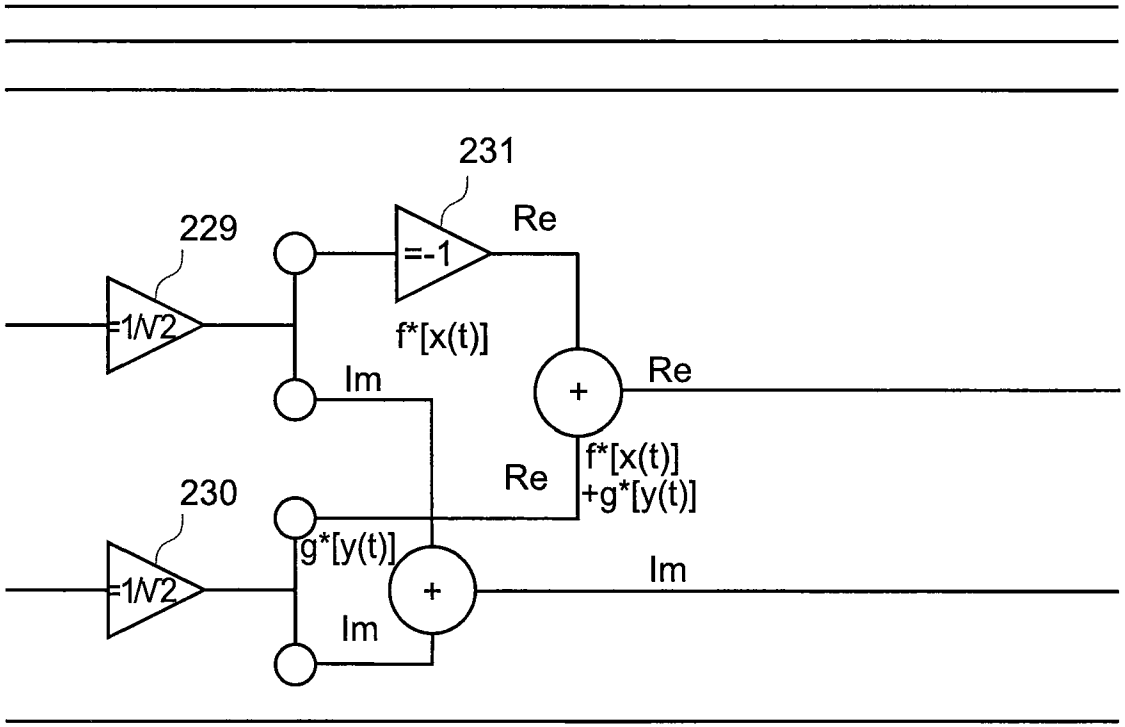
FIG. 9 shows an example of a circuit which, as an enhancement to FIG. 8, maps given signals x(t), y(t) as the sum of the transfer functions $f^*[x(t)]=[x(t)/\sqrt{2}]^*(-1+i)$ and $g^*[y(t)]=[y(t)/\sqrt{2}]^*(1+i)$ on the complex number plane.
Figure 11:
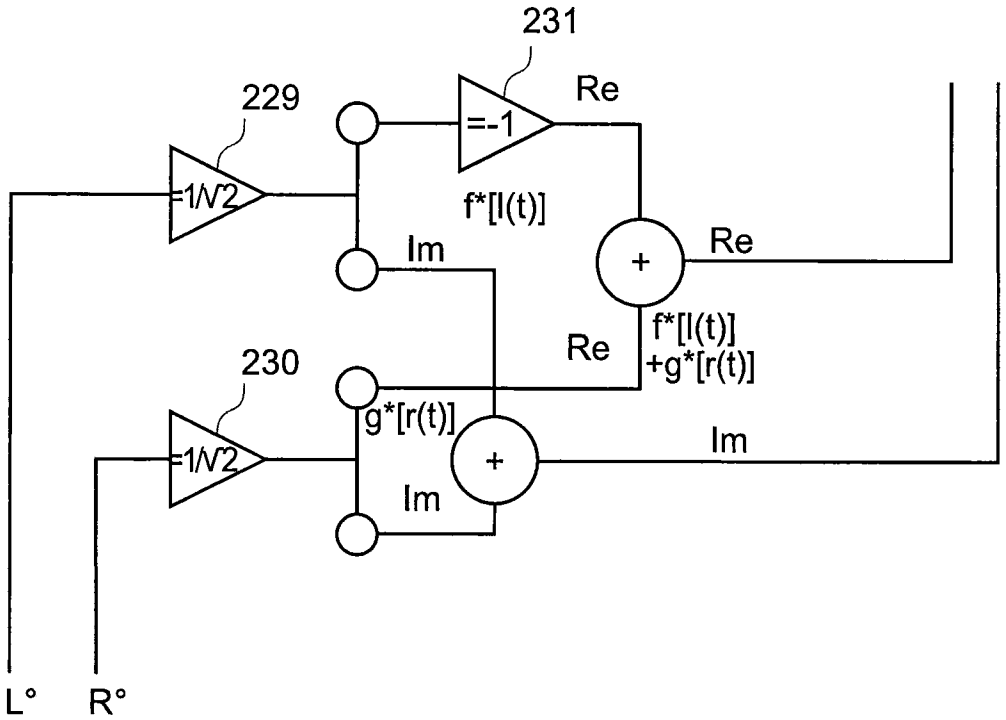
FIG. 11 shows an example of an input circuit for an already existing stereo signal L°, R° prior to transfer to a circuit as shown in FIG. 12 (for determining the localization of the signal) which maps L°, that is to say l(t), and R°, that is to say r(t), as the sum of the transfer functions $f^*[l(t)]=[l(t)/\sqrt{2}]^*(-1+i)$ and $g^*[r(t)]=[r(t)/\sqrt{2}]^*(1+i)$ on the complex number plane.
Figure 12:
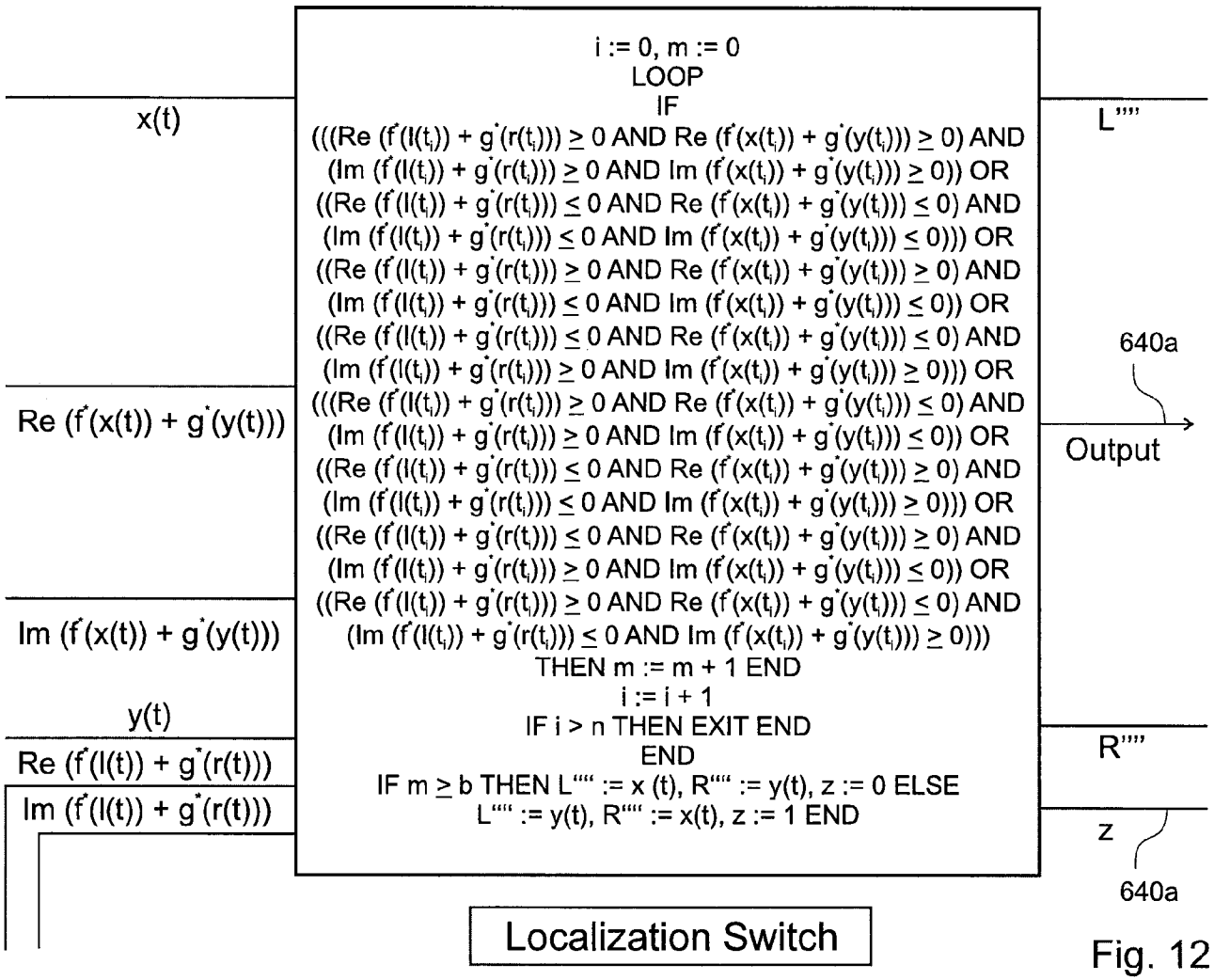
FIG. 12 shows a circuit for determining the localization of the signal, the inputs of which circuit may be connected to the outputs in FIG. 10 or to the outputs in FIG. 11.

If an already existing stereo signal L°, R° is to be mapped by the present system, the correct mapping direction can also be ascertained automatically on behalf of the phantom sources generated by means of the illustrated pseudo-stereophonic methodology, by way of example, as is shown in FIG. 12 (which is directly connected downstream with FIG. 10, whereas FIG. 11 may likewise be added to FIG. 12 for determining the sum of the complex transfer functions $f^*(l(t_i))+g^*(r(t_i))$ for the already existing stereo signal L°, R°; cf. the explanations relating to FIG. 9). In this case, at suitably chosen times $t_i$ (for which not all of the subsequently cited correlating function values of the transfer functions $f^*(x(t_i))+g^*(y(t_i)$ or, respectively, $f^*(l(t_i))+g^*(r(t_i))$ may be equal to zero for at least one case), the already ascertained transfer function $f^*(x(t_i))+g^*(y(t_I))$ as shown in FIG. 9 is compared with the transfer function $f^*(l(t_i))+g^*(r(t_i))$ of the left signal l(t) and the right signal r(t) of the original stereo signal L°, R°. If these transfer functions range in the same quadrant or in the diagonally opposite quadrant of the complex number plane, the total number m of function values from the cited transfer functions which are located in the same quadrant or in the diagonally opposite quadrant of the complex number plane is increased by 1 in each case.

An empirically (or statistically ascertained) stipulatable number b, which should be less than or equal to the number of correlating function values of the transfer functions $f^*(x(t_i))+g^*(y(t_I)$ and $f^*(l(t_i))+g^*(r(t_i))$ unequal to zero, now stipulates the number of necessary matches. Below this number, the left channel x(t) and the right channel y(t) of the stereo signal resulting, for example, from an arrangement as shown in FIGS. 8-10 are swapped.

If an originally stereophonic signal is to be encoded into a mono signal plus the function f describing the directional pattern (or, respectively, the simplifying parameter n of said function) and likewise the parameters ϕ, α, β, λ or ρ (for example for the purpose of data compression) (for an exemplary output 640*a* which may be enhanced by the parameter z, see below), it makes sense to jointly encode the information regarding whether the resulting left channel and the resulting right channel need to be swapped (for example expressed by the parameter z, which takes the value 0 or 1).

With slight modifications, similar circuits to the circuits shown in FIGS. 11 and 12 can be constructed which can be connected directly downstream with FIG. 3 or 4 or 5 or 6 or 7 or else can be used at another location within the electrical circuit or algorithm.

Obtaining stable FM stereo signals by using the present invention, being an example for the evaluation of an existing stereo signal which can be reproduced by two or more loudspeakers.

The invention is also of particular importance in connection with the obtaining of stable FM stereo signals under bad reception conditions (for example in automobiles). In this case, it is possible to achieve stable stereophony by simply using the main channel signal (L+R) as an input signal, which is the sum of the left channel and the right channel of the original stereo signal. The complete or incomplete subchannel signal (L−R), which is the result of subtracting the right channel from the left channel of the original stereo signal, can also be used in this case in order to form a useable S signal or in order to determine or optimize the parameters f (or, respectively, n), which describe the directional pattern of the signal that is to be rendered stereophonic as well as the angle $\phi$ that is to be ascertained manually or by metrology and is enclosed by the main axis and the sound source, the fictitious left opening angle $\alpha$, the fictitious right opening angle $\beta$, the attenuations $\lambda$ or else $\rho$ for the formation of the resulting stereo signal or, resulting therefrom, the gain factor $\rho^*$ for normalizing the left channel and the right channel, resulting from the MS matrixing (for example ascertained in the similar fashion to the logic element 120 as shown in FIG. 8) or from another arrangement according to the invention, on the unit circle (in this case 1 corresponds to the maximum level of 0 dB which has been normalized by using $\rho^*$, where x(t) is the left output signal resulting from this normalization and y(t) is the right output signal resulting from this normalization) or the degree of correlation r of the resulting stereo signal or the parameter a, for example defined by the inequality (9) or else (9a) below, for defining the admissible range of values for the sum of the transfer functions of the resulting output signals (for example the cited complex transfer functions $$f^*[x(t)]=[x(t)/\sqrt{2}]*(-1+i) \tag{5}$$

and $$g^*[y(t)]=[y(t)/\sqrt{2}]*(1+i) \tag{6}$$

where, for $0 \le a \le 1$, for example, the following is true:

$$|Re\{f^*[x(t)]+g^*[y(t)]\}| \le |a^* \cos arg\{f^*[x(t)]+g^*[y(t)]\}| \tag{9}$$

and $$|Im\{f^*[x(t)]+g^*[y(t)]\}| \le |\sin arg\{f^*[x(t)]+g^*[y(t)]\}|) \tag{10}$$

or else in general $$Re^2\{f^*[x(t]+g^*[y(t)]\}*1/a^2+Im^2\{f^*[x(t]+g^*[y(t)]\} \le 1, \tag{9a}$$

or the limit value R*, defined by inequality (11) or else (11a) below, or the deviation $\Delta$, likewise defined by inequality (11) or else (11a) below, for stipulating or maximizing the absolute value of the function values of the sum of these transfer functions (where, for this stipulation or maximization and for the time interval [−T, T] or, respectively, the total number of possible output signals $x_j(t)$, $y_j(t)$, the following is true, for example:

$$0 \le R^* - \Delta \le \int_{-T}^{T} |f^*[x(t)] + g^*[y(t)]| dt \le \max_{\{f^*[x_j(t)], g^*[y_j(t)]\} \in \Phi} \int_{-T}^{T} |f^*[x_j(t)] + g^*[y_j(t)]| dt \le R^* + \Delta \le \int_{-T}^{T} |a * \cos\arg\{f^*[x(t)] + g^*[y(t)]\} + i * \sin\arg\{f^*[x(t)] + g^*[y(t)]\}| dt) \text{ or else} \tag{11}$$

$$0 \le R^* - \Delta \le \int_{-T}^{T} |f^*[x(t)] + g^*[y(t)]| dt \le \max_{\{f^*[x_j(t)], g^*[y_j(t)]\} \in \Phi} \int_{-T}^{T} |f^*[x_j(t)] + g^*[y_j(t)]| dt \le R^* + \Delta \le \int_{-T}^{T} a * \{1/\sqrt{[1-(1-a^2)*\sin^2\arg\{f^*[x(t)] + g^*[y(t)]\}]}\} dt) \tag{11a}$$

or the limit value S* defined above or the deviation $\epsilon$ defined above (for which, by way of example, it must be true that $$0 \le S^* - \epsilon \le \max|Re\{f^*[x(t)]+g^*[y(t)]\}| \le S^* + \epsilon \le 1 \tag{7}$$

or the limit value U* defined above or the deviation $\kappa$ defined above (for which, by way of example, it must be true that $$0 \le U^* - \kappa \le \int_{-T}^{T} |f^*[x(t)] + g^*[y(t)]| dt \le U^* + \kappa), \tag{8}$$

all for determining the mapping width of the stereo signal to be achieved, or the mapping direction of the reproduced sound sources in accordance with the arrangement described above. In any case, the result is stereophonic mapping which is constant in respect of the FM signal.

In particular, the use of compression algorithms or data reduction methods which belong to the prior art or the evaluation of characteristic features, such as the minima or maxima, is also recommended in this case in order to speed up the evaluation of stereophonic or pseudo-stereophonic signals according to the criteria described above.

The invention claimed is:

1. An apparatus for transforming a monophonic input signal into pseudo-stereophonic signals with a variable degree of correlation between a first signal and a second signal of the pseudo-stereophonic signals, comprising either:

a first circuit having an MS matrix for pseudo-stereo conversion and having a first panoramic potentiometer and a second panoramic potentiometer, wherein the MS matrix transforms an MS signal into an LR signal, wherein each panoramic potentiometer has an input, a first output and a second output, wherein the input of the first panoramic potentiometer is connected downstream to a first output of the MS matrix, wherein the input of a second panoramic potentiometer is connected to a second output of the MS matrix, wherein the first output of the first panoramic potentiometer is connected to the first output of the second panoramic potentiometer, and wherein the second output of the first panoramic potentiometer is connected to the second output of the second panoramic potentiometer; or:

a second circuit for pseudo-stereo conversion having an MS matrix which transforms an MS signal into an LR signal and an amplifier, connected upstream to one input of the MS matrix, for amplifying the one input signal for the MS matrix with a gain smaller than one; or:

a third circuit having a modified MS matrix which transforms an MS signal into an LR signal and which contains an adder for forming a composite signal from a first input signal amplified by the factor $(2+\lambda-\rho)$ and a second input signal amplified by the factor $(\lambda+\rho)$ and which comprises a subtractor for forming a difference signal from the first input signal amplified by the factor $(2-\lambda+\rho)$ minus the second input signal amplified by the factor $(\lambda+\rho)$.

2. The apparatus as claimed in claim 1, in which the first output of the first panoramic potentiometer is summed with the first output of the second panoramic potentiometer to the first signal of the pseudo-stereophonic signals, and the second output of the first panoramic potentiometer is summed with the second output of the second panoramic potentiometer to the second signal of the pseudo-stereophonic signals.

3. The apparatus as claimed in claim 1, in which the first panoramic potentiometer and the second panoramic potentiometer use the same attenuation.

4. The apparatus as claimed in claim 1, wherein the first panoramic potentiometer and the second panoramic potentiometer are connected such that the first signal L of the pseudo-stereophonic signals and the second signal R of the pseudo-stereophonic signals is retrieved from the first output L' of the MS matrix and the second output R' of the MS matrix by $$L=\tfrac{1}{2}*L'(1+\lambda)+\tfrac{1}{2}*R'(1-\rho) \text{ and}$$

$$R=\tfrac{1}{2}*L'(1-\lambda)+\tfrac{1}{2}*R'(1+\rho), \text{ with } 1\geq\lambda\geq 0 \text{ and } 1\geq\rho\geq 0.$$

5. The apparatus as claimed in claim 1, in which the attenuations $\lambda$ and $\rho$ are identical.

6. The apparatus as claimed in claim 1, having normalization means for normalizing the level of the maximum of the first signal of the pseudo-stereophonic signals and of the second signal of the pseudo-stereophonic signals, or, equivalently, for normalizing the axis length of the reference system for <x(t), y(t)>.

7. The apparatus as claimed in claim 1, further comprising means for additionally stipulating the mapping width of the resulting pseudo-stereophonic signal by using the possible variation of the degree of correlation r thereof or of an attenuation $\lambda$ or of an attenuation $\rho$.

8. The apparatus as claimed in claim 1, having means for additionally ascertaining or stipulating the mapping direction of a stereo signal.

9. The apparatus as claimed in claim 1, having means for additionally evaluating an existing stereo signal which can be reproduced by two or more loudspeakers.

10. The apparatus as claimed in claim 1, having means for compression or data reduction or other selective evaluation of audio signals.

11. The apparatus as claimed in claim 1, further comprising one or more converters for converting the obtained stereophonic output signals into stereo signals which are intended for reproduction by more than two loudspeakers.

12. The use of the apparatus as claimed in claim 1 for obtaining pseudo-stereophonic signals on the basis of FM stereo signals.

13. A method for transforming a monophonic input signal into pseudo-stereophonic signals with a variable degree of correlation between a first signal and a second signal of the pseudo-stereophonic signals, comprising:

transforming an MS signal to an LR signal an MS matrix, and adjusting the degree of correlation between the first signal and the second signal of the pseudo-stereophonic signals by:

using a first panoramic potentiometer and a second panoramic potentiometer, wherein each panoramic potentiometer has an input, a first output and a second output, wherein the input of the first panoramic potentiometer is connected downstream to a first output of the MS matrix, wherein the input of a second panoramic potentiometer is connected to a second output of the MS matrix, wherein the first output of the first panoramic potentiometer is combined with the first output of the second panoramic potentiometer, and wherein the second output of the first panoramic potentiometer is combined with the second output of the second panoramic potentiometer; or amplifying one input signal for the MS matrix by a gain smaller than one using an amplifier (717) connected upstream to the input of the MS matrix corresponding to the one input signal; or forming in the MS matrix a composite signal by summing a first input signal of the MS matrix amplified by the factor $(2+\lambda-\rho)$ and a second input signal of the MS matrix amplified by the factor $(\lambda+\rho)$ and forming in the MS matrix a difference signal from the first input signal of the MS matrix amplified by the factor $(2-\lambda+\rho)$ minus the second input signal of the MS signal amplified by the factor $(\lambda+\rho)$.

14. The method as claimed in claim 13, wherein the first panoramic potentiometer and the second panoramic potentiometer use the same attenuation.

15. The method as claimed in claim 13, wherein the first panoramic potentiometer and the second panoramic potentiometer are connected such that the first signal L of the pseudo-stereophonic signals and the second signal R of the pseudo-stereophonic signals is computed from the first output L' of the MS matrix and the second output R' of the MS matrix by $$L=\tfrac{1}{2}*L'(1+\lambda)+\tfrac{1}{2}*R'(1-\rho) \text{ and}$$

$$R=\tfrac{1}{2}*L'(1-\lambda)+\tfrac{1}{2}*R'(1+\rho), \text{ with } 1\geq\lambda\geq 0 \text{ and } 1\geq\rho\geq 0.$$

16. The method as claimed in claim 13, in which the attenuations $\lambda$ and $\rho$ are identical.

17. The method as claimed in claim 13, in which the level of the maximum of the first signal of the pseudo-stereophonic signals and of the second signal of the pseudo-stereophonic signals is normalized or, equivalently, the axis length of the reference system for <x(t), y(0> is normalized.

18. The method as claimed in claim 13, further comprising the additional stipulation of the mapping width of the resulting pseudo-stereophonic signal by using the possible variation of the degree of correlation r thereof or of an attenuation $\lambda$ or of an attenuation $\rho$.

19. The method as claimed in claim 13, further comprising the additional ascertainment or stipulation of the mapping direction of an existing stereo signal.

20. The method as claimed in claim 13, comprising the additional evaluation of an existing stereo signal which can be reproduced by two or more loudspeakers.

21. The method as claimed in claim 13, further comprising the additional application of compression methods or data reduction methods or other selective evaluation methods to audio signals.

22. The method as claimed in claim 13, further comprising a conversion of the obtained stereophonic output signals into stereo signals which are reproduced by more than two loudspeakers.

23. The method for obtaining pseudo-stereophonic signals as claimed in claim 13, applied to FM stereo signals.

24. The apparatus as claimed in claim 1, in which the amplifier of the second circuit is arranged upstream from the input of the MS matrix for the S signal.

25. The apparatus as claimed in claim 24, in which the input of the MS matrix for the S signal is computed on the basis of a directional pattern of the mono signal or of an angle that is enclosed by the main axis of a microphone and a sound source or a left opening angle $\alpha$ or a right opening angle $\beta$.

26. The method as claimed in claim 13, in which the amplifier of the second method is arranged upstream from the input of the MS matrix for the S signal.

27. The method as claimed in claim 26, in which the input of the MS matrix for the S signal is computed on the basis of a directional pattern of the mono signal or of an angle that is enclosed by the main axis of a microphone and a sound source or a left opening angle $\alpha$ or a right opening angle $\beta$.

28. The method as claimed in claim 13, in which the first output of the first panoramic potentiometer is summed up with the first output of the second panoramic potentiometer to the first signal of the pseudo-stereophonic signals, and the second output of the first panoramic potentiometer is summed up with the second output of the second panoramic potentiometer to the second signal of the pseudo-stereophonic signals.

* * * * *

UNITED STATES PATENT AND TRADEMARK OFFICE

CERTIFICATE OF CORRECTION

PATENT NO. : 8,958,564 B2
APPLICATION NO. : 13/352762
DATED : February 17, 2015
INVENTOR(S) : Clemens Par It is certified that error appears in the above-identified patent and that said Letters Patent is hereby corrected as shown below:

In the specification, column 7 line 44, equation 7, please replace "$0 \leq S^{*}$- □ $\leq$ max |Re {$f^{*}$[x(t)] + $g^{*}$[y(t)]}| $S^{*}$ + □ $\leq$ 1"

with -- $0 \leq S^{*}$- □ $\leq$ max |Re {$f^{*}$[x(t)] + $g^{*}$[y(t)]}| $\leq S^{*}$ + □ $\leq$ 1A --

In the claims, claim 17, line 56, please replace "y(0>" with -- y(t)> --

Signed and Sealed this
First Day of March, 2016

Michelle K. Lee

Michelle K. Lee
*Director of the United States Patent and Trademark Office*